US009156641B2

(12) United States Patent
Takahashi

(10) Patent No.: US 9,156,641 B2
(45) Date of Patent: Oct. 13, 2015

(54) IMAGE FORMING APPARATUS AND CONTROL METHOD FOR CONTROLLING SHEETS FED FROM A DETACHABLE SHEET FEEDING UNIT USING DETECTED SHEET INTERVALS

(71) Applicant: CANON KABUSHIKI KAISHA, Tokyo (JP)

(72) Inventor: Atsuya Takahashi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 10 days.

(21) Appl. No.: 14/087,423

(22) Filed: Nov. 22, 2013

(65) Prior Publication Data

US 2014/0077451 A1 Mar. 20, 2014

Related U.S. Application Data

(63) Continuation of application No. 12/033,346, filed on Feb. 19, 2008, now Pat. No. 8,626,050.

(30) Foreign Application Priority Data

Feb. 28, 2007 (JP) ..... 2007-050224

(51) Int. Cl.
*G03G 15/00* (2006.01)
*B65H 7/06* (2006.01)
(Continued)

(52) U.S. Cl.
CPC ..... *B65H 7/06* (2013.01); *B41J 11/0095* (2013.01); *B41J 13/0018* (2013.01); *B65H 1/26* (2013.01); *B65H 7/04* (2013.01); *B65H 7/20* (2013.01); *G03G 15/6502* (2013.01);
(Continued)

(58) Field of Classification Search
CPC ..... B65H 2301/44516; B65H 2301/4191; B65H 2513/511; B65H 2513/50; B65H 2513/20; B65H 2301/4452; B65H 2301/44522; B65H 2301/35; B65H 7/06; B65H 7/20; B65H 2402/10; B65H 2404/313; B65H 2511/51; B65H 2511/528; B65H 1/26; B65H 7/04; G03G 15/6502; G03G 15/6564; B41J 13/0018
USPC ..... 399/388, 394, 391, 21
See application file for complete search history.

(56) References Cited

U.S. PATENT DOCUMENTS 5,003,346 A 3/1991 Masuda et al.
5,374,045 A * 12/1994 Milillo ..... 271/9.06
(Continued)

FOREIGN PATENT DOCUMENTS

JP 2005272083 10/2005

*Primary Examiner* — Matthew G Marini
(74) *Attorney, Agent, or Firm* — Fitzpatrick, Cella, Harper & Scinto

(57) ABSTRACT

Detachable sheet feeding units are connected to an image forming apparatus. A transmitting unit transmits a feeding instruction via a signal line to a sheet feeding unit that is to perform sheet feeding. A first sheet detector, which is placed in the sheet feeding unit, detects a sheet that has been fed from the sheet feeding unit. A second sheet detector is provided downstream of the first sheet detector in terms of the sheet conveyance direction. If the feeding instruction is transmitted and a plurality of sheets are fed from the sheet feeding unit, an image formation controller determines whether to cause the image forming operation to continue or stop based upon whether a sheet-to-sheet interval of a plurality of sheets has been detected by the second sheet detector in a state in which the result of detection by the first sheet detector indicates presence of a sheet.

16 Claims, 8 Drawing Sheets

(51) Int. Cl.

| | |
|---|---|
| ***B41J 11/00*** | (2006.01) |
| ***B41J 13/00*** | (2006.01) |
| ***B65H 1/26*** | (2006.01) |
| ***B65H 7/04*** | (2006.01) |
| ***B65H 7/20*** | (2006.01) |

(52) U.S. Cl.

CPC ..... *G03G 15/6564* (2013.01); *B65H 2402/10* (2013.01); *B65H 2404/313* (2013.01); *B65H 2511/51* (2013.01); *B65H 2511/528* (2013.01); *B65H 2513/50* (2013.01); *B65H 2513/511* (2013.01); *B65H 2513/512* (2013.01); *B65H 2513/514* (2013.01); *B65H 2801/06* (2013.01); *G03G 2215/00548* (2013.01); *G03G 2215/00556* (2013.01); *G03G 2215/00721* (2013.01)

(56) References Cited

U.S. PATENT DOCUMENTS

| | | | | |
|---|---|---|---|---|
| 5,667,215 | A | 9/1997 | Yoshino | |
| 5,678,123 | A | 10/1997 | Kim | |
| 6,496,660 | B2 | 12/2002 | Takahashi et al. | |
| 6,533,263 | B2 | 3/2003 | Tamura | |
| 6,636,707 | B2 | 10/2003 | Asakawa et al. | |
| 6,785,478 | B2 | 8/2004 | Takahashi et al. | |
| 2006/0126092 | A1 | 6/2006 | Okanishi et al. | |
| 2006/0193665 | A1 * | 8/2006 | Ueda | 399/388 |

* cited by examiner

IMAGE FORMING APPARATUS AND CONTROL METHOD FOR CONTROLLING SHEETS FED FROM A DETACHABLE SHEET FEEDING UNIT USING DETECTED SHEET INTERVALS

This application is a Continuation of U.S. application Ser. No. 12/033,346, which was filed on Feb. 19, 2008, and allowed Aug. 25, 2013.

BACKGROUND OF THE INVENTION

1. Field of the Invention

The present invention relates to an image forming apparatus, a method of controlling this apparatus and an image forming system.

2. Description of the Related Art

An image forming apparatus to which a sheet feeding unit can be added on as an optional unit in order to increase the capacity for stacking a sheet material has been proposed. Such an optional unit executes the sheet feeding operation in response to a feeding instruction transmitted from the engine controller of the image forming apparatus. The engine controller terminates the sheet feeding operation when a sensor provided on the optional unit senses the leading edge of a sheet. If the leading edge of a sheet cannot be sensed by the sensor despite the fact that sheet feeding has been instructed, on the other hand, then the engine controller causes the optional unit to retry the sheet feeding operation (see the specification of Japanese Patent Application Laid-Open No. 2005-272083).

Assume here that the optional unit transmits status data to the image forming apparatus by serial communication. Assume also that the result of sensing by the sensor provided on the optional unit to sense a sheet also is transmitted as status data.

When optional units are provided in multiple stages, however, the status data sent by serial communication is delayed and there is the danger that this will hamper an increase in the sheet conveying speed. That is, if the optional unit is provided in multiple stages and with higher functionality, there is an increase in optional-unit status data to be checked by the engine controller. As a result, there is a widening of the update interval of the status data that includes the result of sensing by the sensor and, hence, the real-time nature of the status data is lost.

On the other hand, the higher the sheet conveying speed is made, the shorter the time between sheets becomes during continuous printing and, hence, the more difficult it becomes for the sensor to sense the sheet-to-sheet interval. Here the "time between sheets" refers to the difference between the times at which at the trailing edge of a preceding sheet and the leading edge of the succeeding sheet pass by a prescribed position. Further, the "sheet-to-sheet" interval refers to the interval between the trailing edge of a preceding sheet and the leading edge of the succeeding sheet.

In order to solve this problem, it will suffice to enlarge the sheet-to-sheet interval in such a manner that the sensor can sense the sheet-to-sheet interval reliably. However, this will lower the maximum throughput of the image forming apparatus. On the other hand, if a dedicated signal line separate from a serial signal line is provided and the sensor information is sent to the image forming apparatus via this line, throughput can be maintained. However, this can lead to higher cost.

Accordingly, the present invention seeks to solve one of these problems or other problems. For example, the present invention seeks to provide an image forming apparatus in which throughput can be maintained without increasing the number of signal lines. Other problems will be understood from the entirety of the specification.

SUMMARY OF THE INVENTION

The present invention can be implemented as an image forming apparatus connected to one or more detachable sheet feeding units. A transmitting unit transmits a feeding instruction via a signal line to a sheet feeding unit that is to perform sheet feeding. A first sheet detector, which is placed in the sheet feeding unit, detects a sheet that has been fed from the sheet feeding unit. A second sheet detector is provided downstream of the first sheet detector in terms of the sheet conveyance direction. A receiving unit receives status data, which includes results of detection performed by the first and second sheet detectors, via the signal line. If the feeding instruction is transmitted and a plurality of sheets are fed from the sheet feeding unit, an image formation controller determines whether to cause the image forming operation to continue or stop based upon whether a sheet-to-sheet interval of a plurality of sheets has been detected by the second sheet detector in a state in which the result of detection by the first sheet detector indicates presence of a sheet. It should be noted that the present invention may be implemented as an image forming system and method of controlling an image forming apparatus.

Further features of the present invention will become apparent from the following description of exemplary embodiments with reference to the attached drawings.

DESCRIPTION OF THE EMBODIMENTS

Preferred embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

First Embodiment

Figure 1:
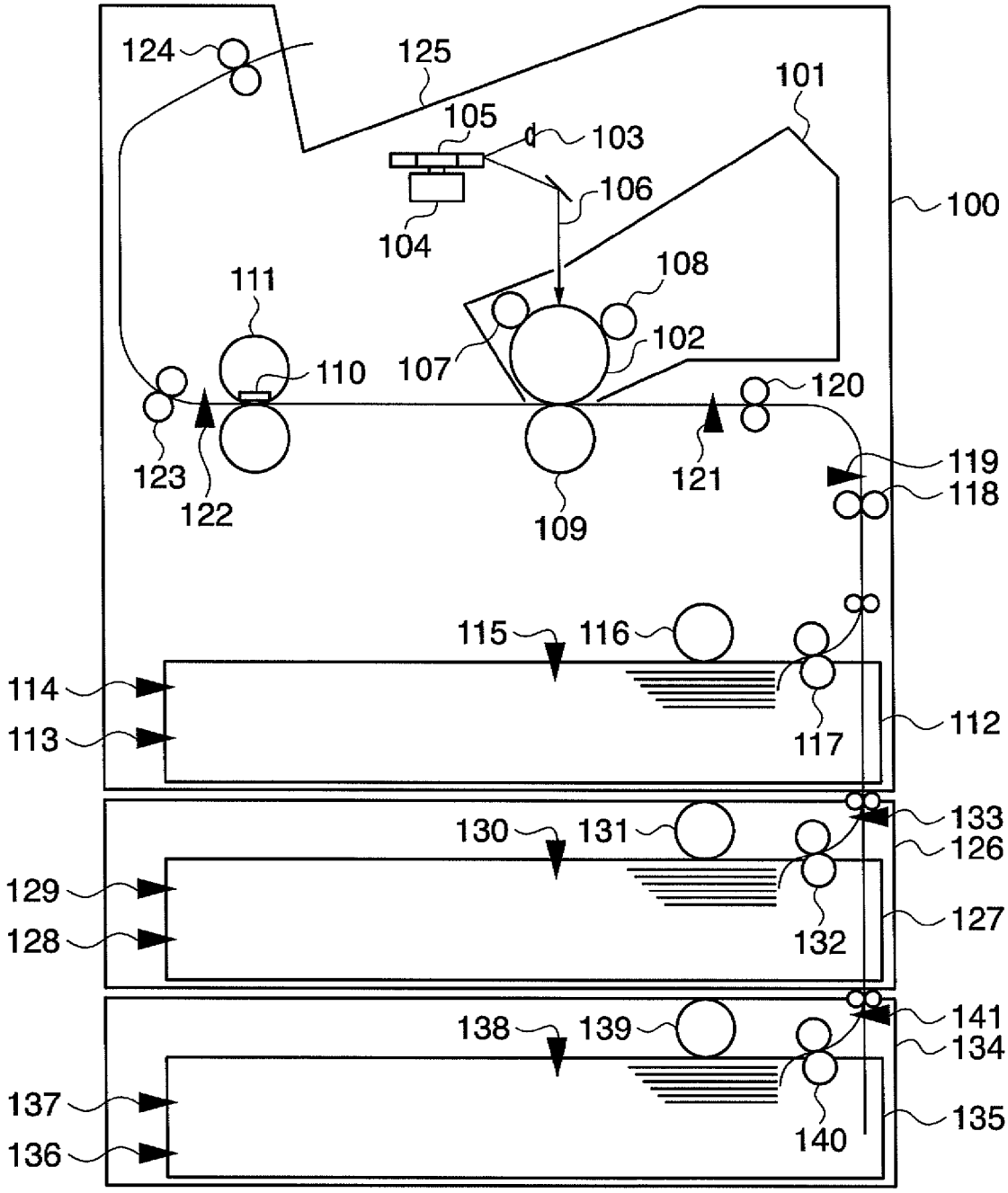
FIG. 1 is a schematic view illustrating the configuration of an image forming apparatus according to a first embodiment of the present invention.

FIG. 1 is a schematic view illustrating the configuration of an image forming apparatus according to a first embodiment of the present invention. The image forming apparatus can be implemented as a printer, copier, multifunction peripheral or facsimile machine, etc.

[Main Body of Image Forming Apparatus]

An image forming apparatus has a main body 100 also referred to as a printer engine. A toner cartridge 101, which is capable of being removably loaded in the main body 100, contains toner. A photosensitive drum 102 is an image carrier for carrying an electrostatic latent image and a toner image, etc. A semiconductor laser 103 is a light source that irradiates the surface of the photosensitive drum 102, which has been uniformly charged, with a laser beam 106. A rotating polygon mirror 105 is driven and rotated by a scanner motor 104, thereby deflecting the laser beam back and forth.

A charging roller 107 charges the photosensitive drum 102 uniformly. A developing unit 108 uses toner to develop an electrostatic latent image that has been formed on the photosensitive drum 102. A transfer roller 109 transfers the toner image, which has been formed by the developing unit 108, to a sheet. A fixing unit, which comprises a fixing heater 110 and a fixing film 111, thermally fuses the toner image that as been transferred to the sheet. It should be noted that the term "sheet" may also be referred to as printing paper, printing material, print medium, transfer material or transfer paper.

A cassette tray 112 accommodates sheets within the main body. A size sensor 113 senses the size of the sheets accommodated in the cassette tray 112. A cassette-loaded sensor 114 is a sensor for determining whether the cassette tray 112 has been loaded in the main body 100. A cassette-sheet sensor 115 is a sensor for detecting whether sheets have been stacked in the cassette tray 112. A pick-up roller 116 is one example of a sheet feeder which, by being rotated through one revolution, feeds a sheet from the cassette tray 112 to a conveyance path. A roller pair 117 is a pair of rollers for feeding a sheet, which has been picked up by the pick-up roller 116, to the conveyance path. When a plurality of sheets have been picked up, the roller pair 117 functions to separate the sheets into individual sheets. That is, the roller pair 117 comprises feed retard rollers, by way of example.

An intermediate roller 118 is one example of a conveyance unit for conveying a sheet, which has been fed from the cassette tray 112, to an image forming unit. Here the image forming unit signifies mainly the photosensitive drum 102, etc. A pre-feed sensor 119 is a sensor for sensing the leading and trailing edges of a sheet that has been transported by the intermediate roller 118. Pre-transfer rollers 120 form a conveyance unit for feeding a conveyed sheet to the photosensitive drum 102.

A top sensor 121 is an example of a measuring unit for measuring the length of a fed sheet in the direction of conveyance. The top sensor 121 is also one example of a second sheet detector provided in the conveyance path downstream of a first sheet detector (e.g., conveyance sensors 133, 141) along the direction of conveyance. The result of detection performed by the top sensor 121 is utilized in order to synchronize the writing (recording/printing) of an image to the photosensitive drum 102 and the conveyance of the sheet. For this reason, the top sensor 121 may also be referred to as a "registration sensor". A fixing sensor 122 is a sensor for sensing whether or not a sheet is present after fixing of an image. Conveyance rollers 123 form a conveyance unit for discharging a sheet, onto which an image has been fixed, to a sheet ejection path. Sheet ejection rollers 124 are rollers in a forward direction in order to eject a sheet, which has been transported by the conveyance rollers 123, onto a drop tray 125.

[Optional Unit (Sheet Feeding Unit)]

A first-stage optional cassette 126 is one example of a sheet feeding unit detachable with respect to the main body 100. A first-stage optional cassette tray 127 is one example of a sheet accommodating unit for accommodating sheets. A first-stage cassette-loaded sensor 128 is a sensor for determining whether the first-stage optional cassette tray 127 has been loaded. A first-stage size sensor 129 senses the size of the sheets stacked in the first-stage optional cassette tray 127. A first-stage sheet sensor 130 is a sensor for detecting whether sheets are present in the cassette tray 127. A first-stage pick-up roller 131 is one example of a sheet feeder which, by being rotated through one revolution, feeds a sheet from the first-stage optional cassette tray 127 to the conveyance path. A first-stage roller pair 132 is an example of a conveyance unit a pair of rollers for feeding a sheet, which has been picked up by the first-stage pick-up roller 131, to the conveyance path. A first-stage conveyance sensor 133 is a sensor for sensing the leading edge of a sheet owing to the sheet feeding operation of the first-stage pick-up roller 131. The first-stage conveyance sensor 133 is placed at a prescribed position within the sheet feeding unit (optional cassette 126) and is one example of a first sheet detector for detecting a sheet that has been fed from the sheet feeding unit.

A second-stage optional cassette 134 is a sheet feeding unit detachable with respect to the first-stage optional cassette 126. The second-stage optional cassette 134 has been indirectly detached to the main body 100 as a matter of course. A second-stage optional cassette tray 135 is one example of a sheet accommodating unit for accommodating sheets. A second-stage cassette-loaded sensor 136 is a sensor for determining whether the second-stage optional cassette tray 135 has been loaded. A second-stage size sensor 137 senses the size of the sheets accommodated in the second-stage optional cassette tray 135. A second-stage sheet sensor 138 is a sensor for detecting whether sheets are present in the second-stage optional cassette tray 135. A second-stage pick-up roller 139 is one example of a sheet feeder which, by being rotated through one revolution, feeds a sheet from the second-stage optional cassette tray 135 to the conveyance path. A second-stage roller pair 140 is an example of a conveyance unit a pair of rollers for feeding a sheet, which has been picked up by the second-stage pick-up roller 139, to the conveyance path. A second-stage conveyance sensor 141 is a sensor for sensing the leading edge of a sheet owing to the sheet feeding operation of the second-stage pick-up roller 139. The second-stage conveyance sensor 141 is placed at a prescribed position within the sheet feeding unit (optional cassette 134) and is one example of a first sheet detector for detecting a sheet that has been fed from the sheet feeding unit.

[Controller of Image Forming Apparatus]

Figure 2:
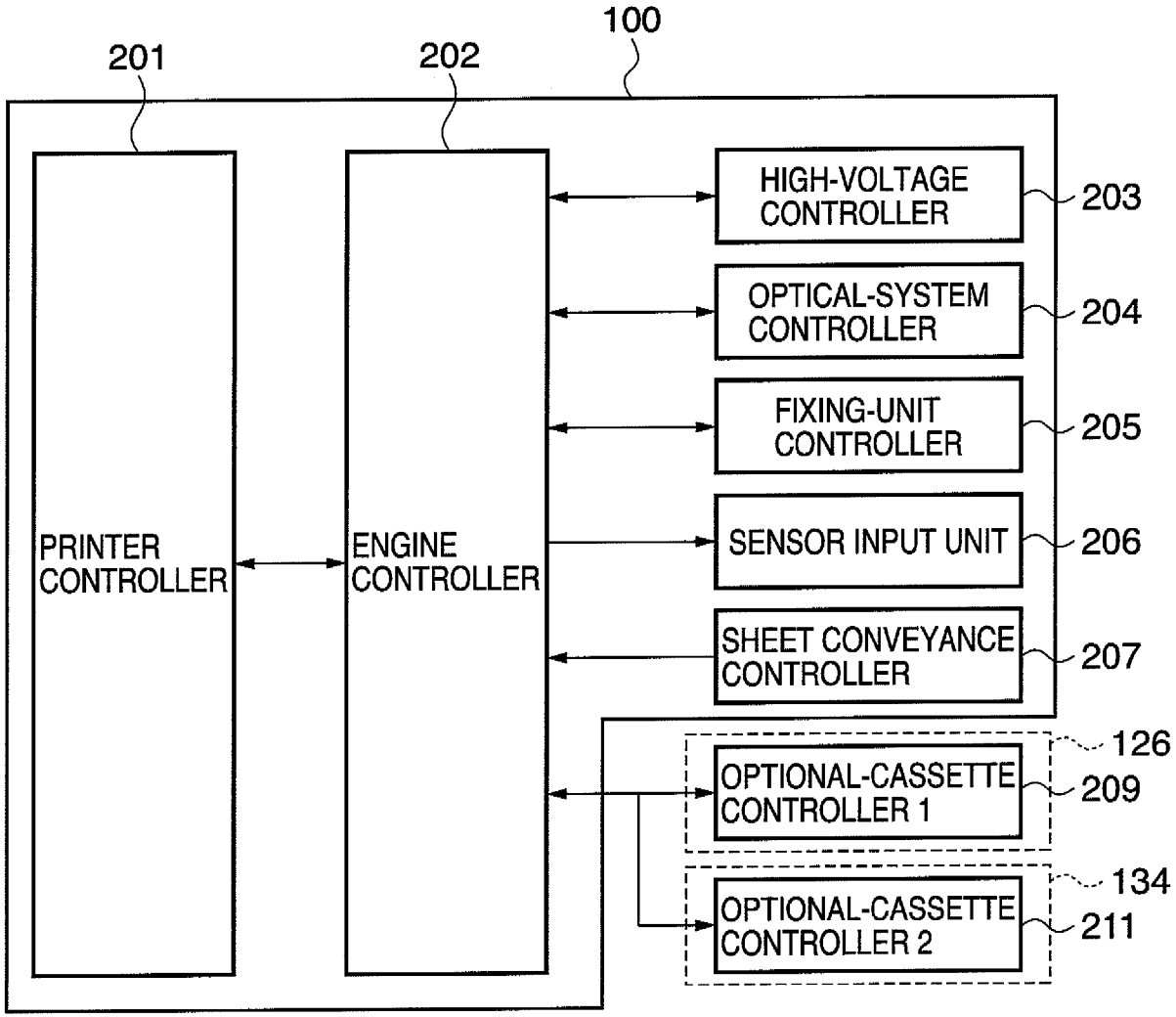
FIG. 2 is a block diagram regarding a controller of the image forming apparatus.

FIG. 2 is a block diagram regarding the controller of the image forming apparatus. A printer controller 201 expands image data, which is sent from an external device such as a host computer (not shown), into bit data. Further, the printer controller 201 exercises control such as control of display of messages representing the occurrence of jamming.

An engine controller 202 controls each portion of the image forming apparatus in accordance with commands from the printer controller 201 and communicates internal information to the printer controller 201. In accordance with a command from the engine controller 202, a high-voltage controller 203 controls high-voltage output at each of the charging, development and transfer steps, etc. In accordance with a command from the engine controller 202, an optical-system controller 204 exercises control so as to drive or halt the scanner motor 104 and fire the laser beam. In accordance with a command from the engine controller 202, a fixing-unit controller 205 exercises control so as to turn the feed of current to the fixing heater 110 on or off.

A sensor input unit 206 notifies the engine controller 202 of whether or not a sheet is present at the pre-feed sensor 119, top sensor 121 and fixing sensor 122 and of the result of sensing by the cassette-sheet sensor 115.

In accordance with a command from the engine controller 202, a sheet conveyance controller 207 controls the driving and stopping of motors and rollers (not shown) in order to convey a sheet. Examples of what are to be controlled are the pick-up roller 116, roller pair 117, intermediate roller 118, pre-transfer rollers 120, fixing film 111 and ejection rollers 124.

An optional-cassette controller 209 is a control unit mounted on the first-stage optional cassette 126. The optional-cassette controller 209 controls the driving of the pick-up roller 131 and roller pair 132, etc., in accordance with a command from the engine controller 202. Further, via the serial signal line, the optional-cassette controller 209 notifies the engine controller 202 of the sheet size, information as to whether or not a sheet is present, and whether or not the optional cassette tray 127 has been loaded.

An optional-cassette controller 211 is a control unit mounted on the second-stage optional cassette 134. The optional-cassette controller 211 controls the driving of the pick-up roller 139 and roller pair 140, etc., in accordance with a command from the engine controller 202. Further, via the serial signal line, the optional-cassette controller 211 notifies the engine controller 202 of the sheet size, information as to whether or not a sheet is present, and whether or not the optional cassette tray 135 has been loaded.

Figure 3:
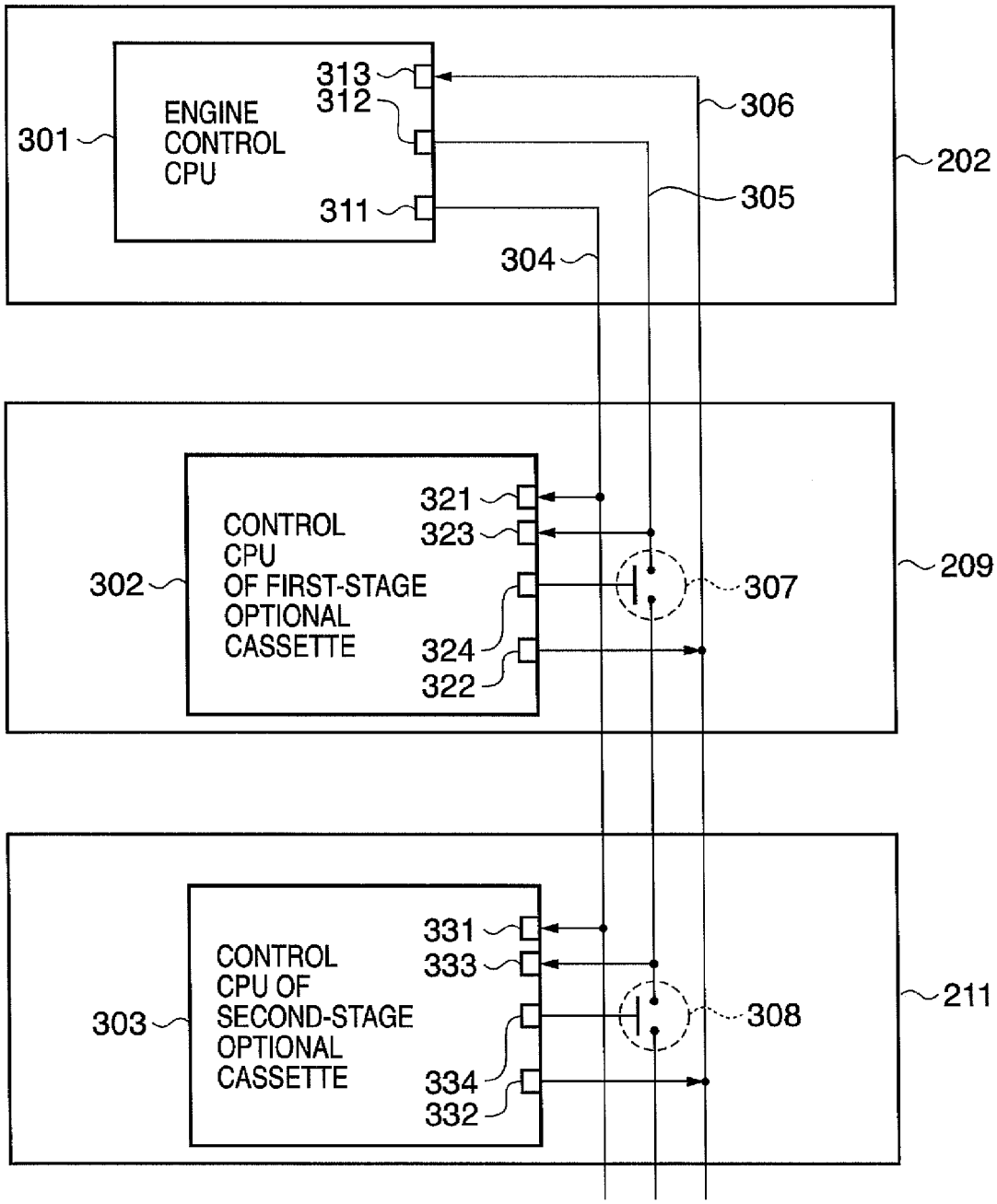
FIG. 3 is a diagram illustrating an example of a serial communication system applied to an image forming apparatus and sheet feeding units.

FIG. 3 is a diagram illustrating an example of a serial communication system applied to an image forming apparatus and sheet feeding unit. Reference will be had to FIG. 3 to describe the electrical connection relating to serial communication between the engine controller 202 and the optional-cassette controllers 209, 211 as well as a method of assigning identification information (referred to as "device ID" below) of each optional cassette.

An engine control CPU 301 is the core control circuit of the engine controller 202. The engine control CPU 301 functions as feeding-failure determination unit and image formation controller. The feeding-failure determination unit decides that feeding failure has occurred if the status data indicates absence of a sheet continuously from transmission of feeding instruction until elapse of a first threshold time. The first threshold time is decided from the standpoint of detecting feeding failure in the sheet feeding unit, by way of example. The image formation controller stops image formation if feeding failure has been detected. On the other hand, the image formation controller allows image formation to continue if, after transmission of a feeding instruction, the status data indicates a change from absence of a sheet to presence of a sheet before the first threshold time elapses. Further, the image formation controller allows image formation to continue if, after transmission of a feeding instruction, the status data indicates the presence of a sheet continuously until the first threshold time elapses.

Further, the engine control CPU 301 functions as a first sheet-to-sheet interval detector for detecting the sheet-to-sheet interval between a preceding sheet and the succeeding sheet based upon the status data. Further, the engine control CPU 301 functions as a second sheet-to-sheet interval detector for detecting the sheet-to-sheet interval between a preceding sheet and a succeeding sheet in accordance with whether the result of sensing by the top sensor 121 indicates absence or presence of a sheet. In this case, the engine control CPU 301 allows image formation to continue when a sheet-to-sheet interval within the second threshold time has been detected. The second threshold time is decided in order to detect sheet-retention jam that occurs in the conveyance path, by way of example. On the other hand, the engine control CPU 301 causes image formation to stop when a sheet-to-sheet interval cannot be detected even upon elapse of the second threshold time. It should be noted that the second sheet-to-sheet interval detector may also function in a case where the sheet-to-sheet interval cannot be detected by the first sheet-to-sheet interval detector. Further, the engine control CPU 301 may also function as a controller for controlling image formation in accordance with the sheet-to-sheet interval detected by the first sheet-to-sheet interval detector or second sheet-to-sheet interval detector.

The engine control CPU 301 may also incorporate a first timer serving as a first timekeeping unit for measuring the first threshold time, and a second timer serving as a second timekeeping unit for measuring the second threshold time. In this case, the engine control CPU 301 may function as a timekeeping controller for controlling the start timing of timekeeping by the second timekeeping unit in accordance with the status data that includes the result of detection by the first sheet detector.

A control CPU 302 is a control circuit for controlling the controller 209 of the optional cassette 126. A control CPU 303 is a control circuit for controlling the controller 211 of the optional cassette 134.

Serial communication between the engine control CPU 301 and control CPUs 302, 303 is executed in sync with a clock signal (referred to as a "CLK signal" below) that a clock generator 311 of the engine control CPU 301 outputs to a CLK signal line 304. "CLK" is the abbreviation of "clock". The control CPUs 302, 303 have clock input units 321, 331, respectively. The control CPUs 302, 303 send and receive data in sync with the CLK signal that enters from the clock input units 321, 331, respectively.

A command transmission unit 312 of the engine control CPU 301 transmits data (referred to as a "CMD signal" below) such as commands and instructions to the control CPUs 302, 303 of the optional cassettes. "CMD" is the abbreviation of "command". The command transmission unit 312 is an example of a transmission unit for transmitting a feeding instruction via the signal line to a sheet feeding unit that is to feed a sheet. Command receiving units 323, 333 of the control CPUs 302, 303, respectively, receive the CMD signal. The command receiving units 323, 333 function as first receiving units for receiving a sheet feeding instruction from the image forming apparatus via the signal line.

A receiving unit 313 of the engine control CPU 301 receives status data (referred to as an "STS signal" below), which has been transmitted by status transmission units 322, 332 of the respective control CPUs 302, 303 of the respective optional cassettes, via an STS signal line 306. "STS" is the abbreviation of "status". Thus, in this embodiment, clock-synchronized serial communication is executed using three signal lines (communication lines). The receiving unit 313 is an example of a receiving unit for receiving, via the STS signal line 306, status data including the results of detection by the conveyance sensors 133, 141 that function as first sheet detectors. Further, the status transmission units 322, 332 function as first transmission units for transmitting status data, which includes the results of detection by the first sheet detector, to the image forming apparatus via the signal line.

A CMD signal line 305 branches into two portions within the controller 209 of the first-stage optional cassette. One portion of the branched CMD signal line 305 is connected to the command receiving unit 323 of the control CPU 302. The other portion of the branched CMD signal line 305 is connected to a CMD signal switch 307. In accordance with a changeover instruction that is output from a changeover unit 324 of the control CPU 302, the CMD signal switch 307 electrically changes over the CMD signal line 305 to connect it to or disconnect it from the optional cassette downstream.

If the CMD signal switch 307 is in the connected sate, the CMD signal line 305 is connected to the optional-cassette controller 211. As a result, the command which the engine control CPU 301 transmits via the CMD signal line 305 is sent to the control CPU 302 and control CPU 303. If the CMD signal switch 307 is not connected, then the command which the engine control CPU 301 transmits via the CMD signal line 305 is not sent to the control CPU 303. The same hold true for a CMD signal switch 308. In accordance with a changeover instruction that is output from a changeover unit 334 of the control CPU 302, the CMD signal switch 308 electrically changes over the CMD signal line 305 to connect it to or disconnect it from the optional cassette downstream.

The engine control CPU 301 assigns device IDs to the control CPUs of each of the optical cassettes in order to perform communication with all of the connected optional cassettes. The assignment of an ID is executed by transmitting a device-ID designating command that specifies the device ID (e.g., device ID=1).

When assignment starts (e.g., at the introduction of power, etc.), the control CPU 302 of the first-stage optional cassette is placed in the disconnected state. Consequently, the device-ID designating command is not transmitted to the control CPUs of the optional cassettes from those of the second stage onward. Thus, the control CPU of each optional cassette holds its own CMD signal switch in the disconnected state until the device ID is assigned.

Upon receiving the device-ID designating command in a state in which a device ID has not been assigned, the control CPU 302 stores the specified device ID (device ID=1) in a storage unit within the CPU as its own ID. The storage unit is implemented by a memory or the like. The status transmission unit 322 transmits the fact that device ID=1 has been decided to the engine control CPU 301 via the STS signal line 306 as status sent back in response to the device-ID designating command. The changeover unit 324 thenceforth changes over the CMD signal switch 307 to the connected state.

The engine control CPU 301 determines whether the status data indicates that the device ID (device ID=1) has been decided for the first-stage optional cassette 126. If the device ID of the optional cassette 126 is decided, then the engine control CPU 301 transmits a device-ID designating command that specifies another ID (e.g., device ID=2). Since the CMD signal switch 307 is in the connected state at this time, this device-ID designating command is transmitted to the control CPUs 302 and 303.

Since the device ID has already been decided, the control CPU 302 ignores the device-ID (device ID=2) designating command. On the other hand, if a device ID has not been assigned, then the control CPU 303 of the second-stage optional cassette stores device ID=2 in the storage unit as its own ID. The status transmission unit 322 transmits the fact that device ID=2 has been decided to the engine control CPU 301 via the STS signal line 306 as status sent back. The changeover unit 334 thenceforth changes over the CMD signal switch 308 to the connected state.

From this point onward, the engine control CPU 301 sets different device IDs and transmits the device-ID designating command until status sent back in response to the ID-designating command can no longer be received from optional cassettes. As a result, device IDs specific to all optional cassettes connected to the image forming apparatus directly or indirectly can be assigned.

After the device IDs of all connected optional cassettes have been decided, the engine controller 202 transmits a command designating a device ID to the optional cassette that is desired to be operated. As a result, each of the optional cassettes can be controlled individually.

With serial communication, generally an interval in which a command is transmitted and an interval in which status data is transmitted repeat alternatingly along the time axis. If the status-data transmission interval is divided into a plurality of data intervals and each data interval is assigned to a device ID, then status data of each optional cassette with respect to one command can be acquired by the engine controller 202 by a single communication operation. It should be noted that if a data interval is divided, the amount of data that can be transmitted by one optional cassette decreases. Further, if the type of sensor data, etc., increases, then the sensor information must be transmitted a plurality of times and the period of time over which specific sensor information is updated is prolonged. The real-time nature of specific sensor information thus tends to be lost.

Figure 4:
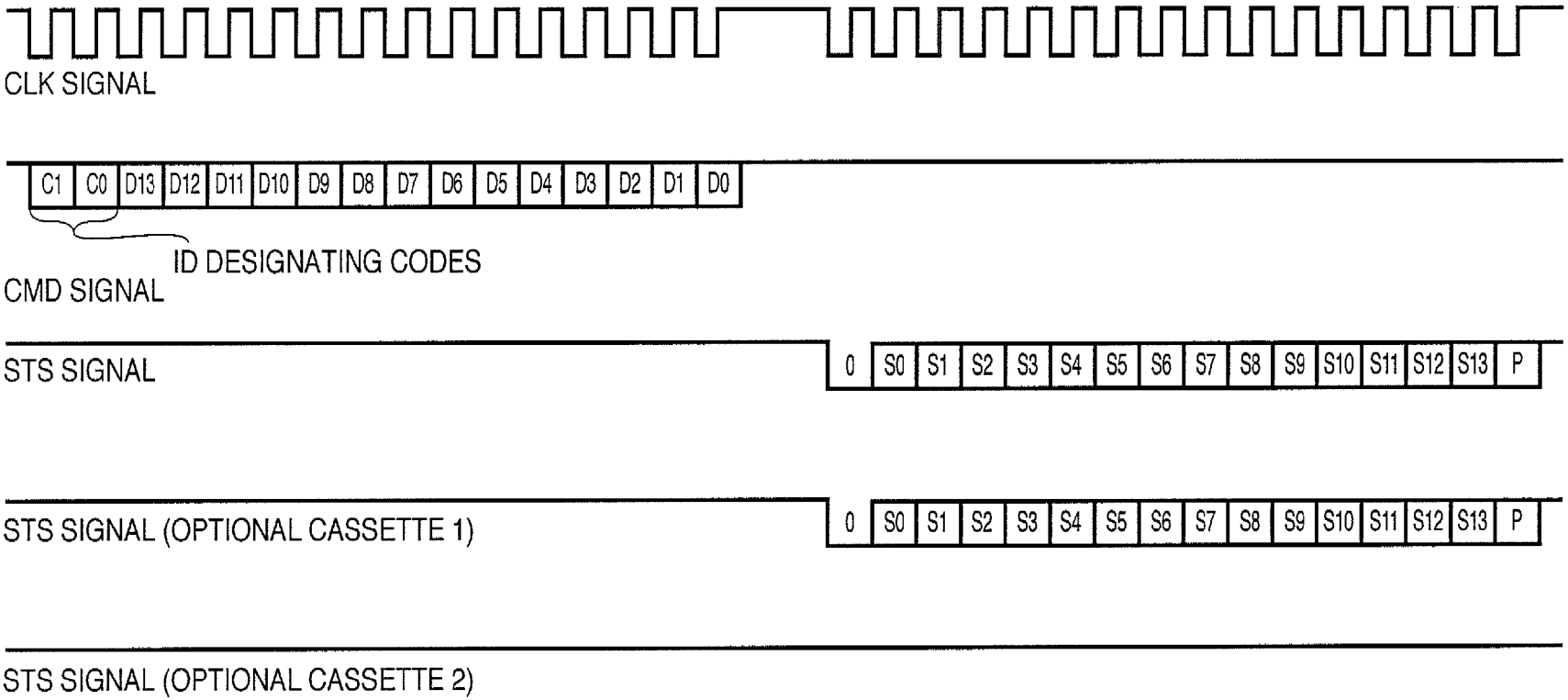
FIG. 4 is a diagram illustrating the data structure and timing chart of a clock signal, command signal and status signals.

FIG. 4 is a diagram illustrating the data structure and timing chart of a clock signal, command signal and status signals. When the engine control CPU 301 transmits a command, it performs the transmission over the CLK signal line 304. At this time the engine control CPU 301 transmits data to the control CPUs 302, 303 of the optional cassettes one bit at a time in sync with the falling edge of the clock on the CLK signal line 304. The control CPUs of the optional cassettes receive the data one bit at a time in sync with the rising edge of the clock on the CLK signal line 304.

In accordance with FIG. 4, a command comprises ID designating codes of C0, C1 and data codes of D0 to D13. For example, C0="0", C1="1" represent a command the destination of which is the first-stage optional cassette. On the other hand, C0="1", C1="0" represent a command the destination of which is the second-stage optional cassette.

When status data is output over the STS signal line 306, the control CPU 302 outputs "0" as the first bit of data in sync with the falling edge of the signal on the CLK signal line 304. Next, the control CPU 302 outputs status data S0 to S13 and parity data P of S0 to S13 serving as an error detection code.

It should be noted that the control CPU 303 of the second-stage optional cassette does not output status data if the ID of a command is not the device ID assigned to itself. That is, each control CPU outputs its own status data only when the ID of the command is the device ID assigned to itself.

Figure 5A:
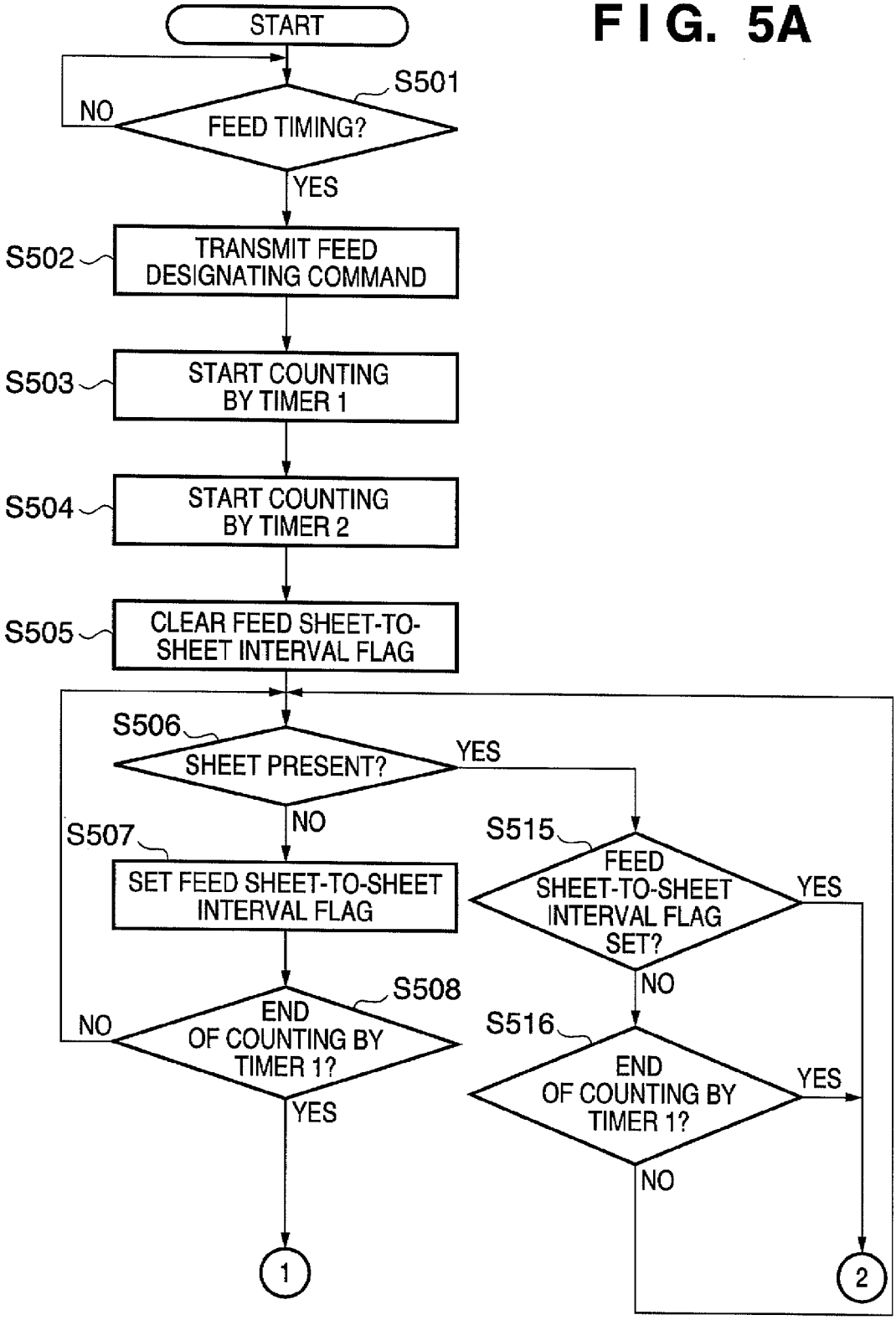
FIGS. 5A and 5B are flowcharts illustrating a control method according to the first embodiment.
Figure 5B:
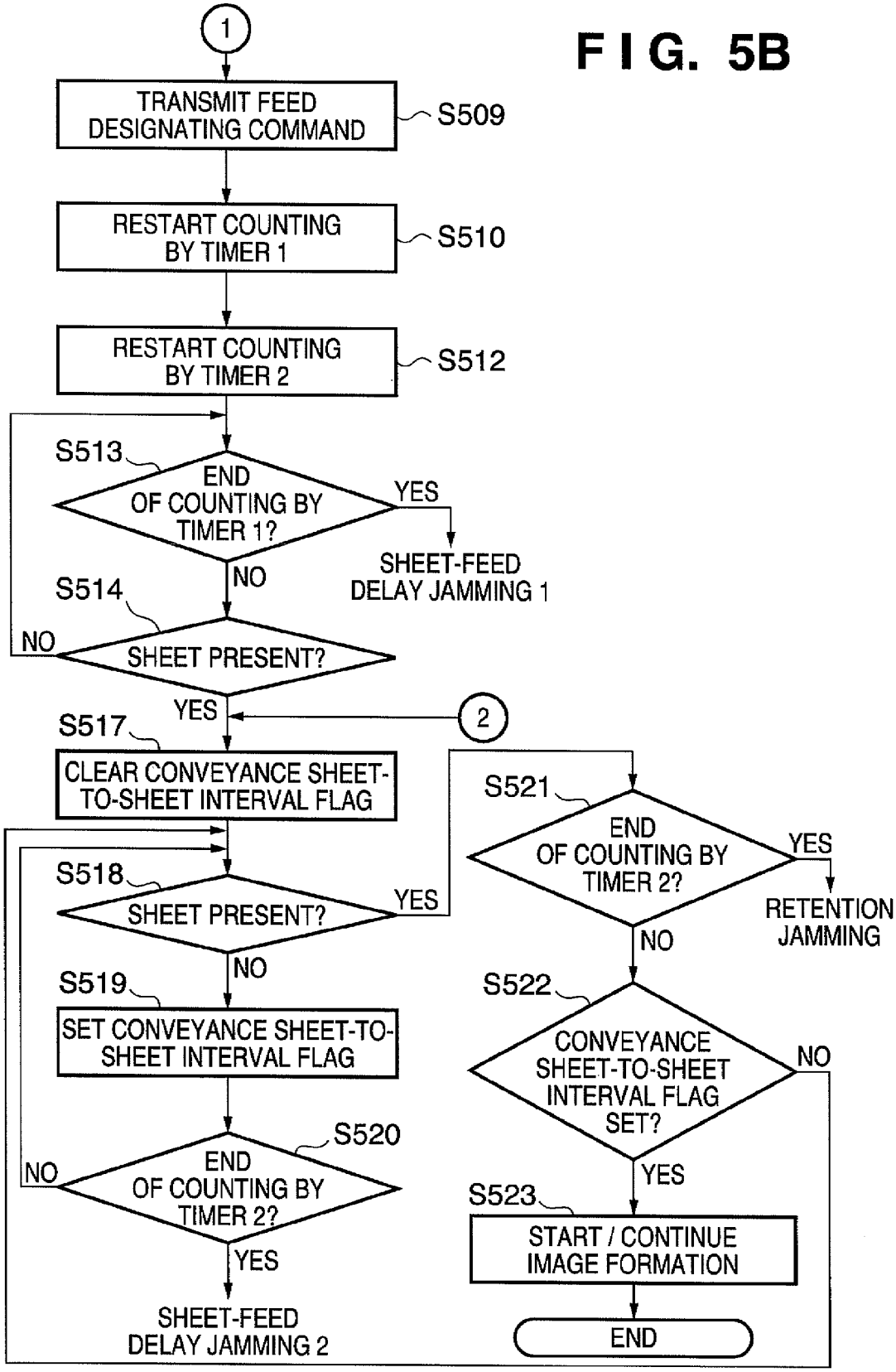

FIGS. 5A and 5B are flowcharts illustrating a control method according to the first embodiment. Here it is assumed that a sheet is fed from the first-stage optional cassette 126 connected to the main body 100. Further, assume that the engine control CPU 301 checks the state of sheet conveyance using the first-stage conveyance sensor 133 and top sensor 121. States of sheet conveyance include, e.g., presence of a sheet, absence of a sheet, sheet-to-sheet interval, retention jamming and delay jamming, etc. It should be noted that the second-stage optional cassette 134 may just as well be the cassette that is to feed a sheet. In such case the structural elements of the second-stage optional cassette should be read in place of the structural elements of the first-stage optional cassette. Further, a sheet sensor other than the top sensor 121 may be used.

It is assumed that if the printer controller 201 specifies continuous printing, the engine control CPU 301 adjusts the feed timing in such a manner that the sheet-to-sheet interval between a preceding sheet and the succeeding sheet will be rendered constant. Here "preceding sheet" means the sheet ahead of the sheet that follows, and "succeeding sheet" means the sheet that follows the sheet ahead.

At step S501, the engine control CPU 301 determines whether the timing for the feeding of a sheet has arrived. Whether or not this timing has arrived is judged based upon whether the top sensor 121 has sensed the trailing edge of a sheet, by way of example. Naturally a timing at which another sheet sensor has sensed the trailing or leading edge of a sheet may be employed as the criterion. When the timing for feeding a sheet arrives, control proceeds to step S502.

At step S502, the command transmission unit 312 of the engine control CPU 301 transmits, via the CMD signal line 305, a feed designating command that specifies the first-stage optional cassette as the destination. Upon receiving this feed designating command, the control CPU 302 starts the sheet feeding operation. For example, the control CPU 302 drives the first-stage pick-up roller 131 by driving a solenoid, which is not shown.

At step S503, the engine control CPU 301 causes a first timer to start timekeeping (counting) from an initial value in order to detect feeding failure. It is assumed that the first timer is incorporated within the engine control CPU 301. At step S504, the engine control CPU 301 causes a second timer to start timekeeping (counting) from an initial value in order to detect the state of sheet conveyance in accordance with the result of sensing by the top sensor 121. It is assumed that the second timer also is incorporated within the engine control CPU 301.

At step S505, the engine control CPU 301 clears a feed sheet-to-sheet interval flag. "Clear" is synonymous with the resetting of the feed sheet-to-sheet interval flag. The feed sheet-to-sheet interval flag is a flag that is set when the first-stage conveyance sensor 133 has sensed the sheet-to-sheet interval between a preceding sheet and the succeeding sheet. If a sheet-to-sheet interval has not been sensed, the feed sheet-to-sheet interval flag is maintained in the initial (reset) state.

At step S506, the engine control CPU 301 determines whether "sheet present" is indicated by the result of sensing by the conveyance sensor 133 included in the status data received by the status receiving unit 313. It should be noted that it is permissible to presume that the command transmission unit 312 transmits a command, which requests the result of sensing by the first-stage conveyance sensor 133, to the first-stage optional cassette 126 in advance. If presence of a sheet cannot be sensed (i.e., if absence of a sheet is sensed), control proceeds to step S507. If presence of a sheet is sensed, control proceeds to step S515.

At step S507, the engine control CPU 301 sets the feed sheet-to-sheet interval flag. Then, at step S508, the engine control CPU 301 monitors the value of the count in the first timer and determines whether counting has ended. For example, the engine control CPU 301 checks to determine whether the value of the count has exceeded the first threshold time decided in order to detect feeding failure such as sheet-feed delay jamming. "Sheet-feed delay jamming" refers to jamming in which a sheet does not reach a prescribed position within a prescribed period of time following transmission of a feeding instruction. Sheet-feed delay jamming can result from failure to pick up a sheet in an optional cassette or can be caused by jamming of a sheet that occurs in the conveyance path ahead of the conveyance sensor. Control returns to step S506 if counting by the first timer has not ended. If counting by the first time has ended, on the other hand, then the engine control CPU 301 recognizes that this means failure of the pick-up roller 131 to feed a sheet. Accordingly, the engine control CPU 301 executes a retry operation (steps S509 to S513) as a recovery measure.

At step S509, the engine control CPU 301 again transmits a feed designating command to the control CPU 302 of the first-stage optional cassette via the CMD signal line 305. Upon receiving this feed designating command, the control CPU 302 executes the sheet feeding operation again.

At step S510, the engine control CPU 301 restarts the counting by the first timer for detecting feed delay. That is, the first timer starts counting again from the initial value. Next, at step S512, the engine control CPU 301 restarts the counting by the second timer for detecting retention jamming. That is, the second timer start counting again from the initial value.

At step S513, the engine control CPU 301 determines whether sheet-feed delay jamming has occurred based upon whether or not counting by the first timer has ended. If counting by the first timer has ended, then the engine control CPU 301 recognizes that sheet-feed delay jamming has occurred and executes jam troubleshoot processing. This is processing for stopping image formation or displaying an error message, by way of example.

If counting by the first timer has ended, on the other hand, then control proceeds to step S514. Here the engine control CPU 301 determines whether the conveyance sensor 133 has detected presence of a sheet. The details of step S513 are as described above at step S506. If presence of a sheet cannot be detected, then control returns to step S513. If presence of paper can be detected, on the other hand, then this means that sheet feeding has succeeded and, hence, control proceeds to step S517.

If the conveyance sensor 133 senses presence of a sheet at step S506, control proceeds to step S515, as described above. At step S515, the engine control CPU 301 determines whether the feed sheet-to-sheet interval flag has been set. It should be noted that if the feed sheet-to-sheet interval flag has been set, this indicates that absence of a sheet and presence of a sheet have been detected one time (i.e., that the sheet-to-sheet interval has been detected). This also means that feeding has succeeded. In this case, control proceeds to step S517. On the other hand, if the feed sheet-to-sheet interval flag is found to still be in the reset state, this indicates that the state of paper presence is continuing. This means that retention jamming has occurred in the vicinity of the conveyance sensor 133 or that the sheet-to-sheet interval is too short and could not be detected. Alternatively, there is the possibility that the engine control CPU 301 could detect the sheet-to-sheet interval because, although the conveyance sensor 133 could detect the sheet-to-sheet interval, a communication delay or communication error occurred in the status data representing the absence or presence of a sheet. At this time, therefore, a conclusion cannot be drawn as to what event has occurred. Accordingly, control proceeds to step S516.

At step S516, the engine control CPU 301 determines whether counting by the first timer has ended. If counting has not ended, control returns to step S506. If counting has ended, on the other hand, then control proceeds to step S517 in order to detect the sheet-to-sheet interval based upon the top sensor 121 and second timer. One reason for the end of counting by the first timer is that the sheet-to-sheet interval could not be detected because a communication delay or communication error occurred in the status data.

At step S517, the engine control CPU 301 resets a conveyance sheet-to-sheet interval flag. The conveyance sheet-to-sheet interval flag is a flag that is set when the top sensor 121 senses the sheet-to-sheet interval. At step S518, the engine control CPU 301 determines whether the top sensor 121 has sensed presence (absence) of a sheet. The fact that the top sensor 121 has sensed absence of a sheet means that the sheet-to-sheet interval could be detected. Control therefore proceeds to step S519, where the engine control CPU 301 sets the conveyance sheet-to-sheet interval flag. Then, at step S520, the engine control CPU 301 determines whether counting by the second timer has ended. If counting by the second timer has not ended, control returns to step S518. Whether or not counting has ended is determined based upon whether or not the value of the count in the second timer has exceeded the second threshold time.

The fact that the second time has finished counting means that although a sheet could be detected in the optional cassette 126, this sheet could not be detected in the main body 100 of the image forming apparatus. If the second timer has finished counting, the fact that sheet-feed delay jamming has occurred is recognized and the engine control CPU 301 execute jam troubleshoot processing.

If presence of a sheet has been detected at step S518, then control proceeds to step S521, where the engine control CPU 301 determines whether the second timer has finished counting. It should be noted that step S521 is processing similar to that at step S520. If counting has ended, retention jamming has occurred. Accordingly, the engine control CPU 301 executes jam troubleshoot processing. If counting has not ended, control proceeds to step S522.

At step S522, the engine control CPU 301 determines whether the conveyance sheet-to-sheet interval flag has been set. In other words, if what is to be detected is the first sheet of a print job, the top sensor 121 senses the presence of a sheet at step S518 after the absence of a sheet is detected, and a transition is then made to step S512. However, with regard to sheets from the second sheet onward of a print job, there is the possibility that a preceding sheet will still be present at the top sensor 121 immediately after the conveyance sensor 133 has sensed the leading edge of the succeeding sheet. Accordingly, control transitions to step S522 without the conveyance sheet-to-sheet interval flag being set (i.e., with the flag being left in the reset state). If the decision processing of step S522 is not provided, there is the danger that feeding of the succeeding sheet will be recognized erroneously has having succeeded despite the fact that the preceding sheet was detected. Accordingly, step S522 is added on in order to suppress such misrecognition. The above-described step S515 is provided for the same reason. If the conveyance sheet-to-sheet interval flag has not been set, control returns to step S518.

If the conveyance sheet-to-sheet interval has been set, on the other hand, then this means that the sheet-to-sheet interval between a preceding sheet and the succeeding sheet (namely the leading edge of the succeeding sheet) has been detected. Accordingly, control proceeds to step S523 and the engine control CPU 301 starts or continues image formation.

Timing out of the timer at step S516 can be construed to mean that the sheet-to-sheet interval is too short (i.e., the sheet-to-sheet interval could not be detected) or that the cause is communication delay of the status data. Which of these events has occurred cannot be specified. On the other hand, timing out of the timer at step S521 is the result solely of non-detection of the sheet-to-sheet interval by the top sensor 121. The reason is that since the top sensor 121 and engine control CPU 301 have not been connected by a serial signal line, communication delay ascribable to multistage connection of optional cassettes basically does not occur.

In accordance with this embodiment, the engine control CPU 301 allows image formation to continue even in a case where the status data continuously indicates presence of a sheet from transmission of a feeding instruction until elapse of the first threshold time. That is, when the sheet-to-sheet interval cannot be detected based upon the status data, the engine control CPU 301 presumes that the sheet-to-sheet interval is too short and cannot be detected, as a result of which erroneous detection of jamming is suppressed. By extension, an image forming apparatus that is capable of maintaining throughput without adding on signal lines to the three serial signal lines is provided.

In accordance with this embodiment, the engine control CPU 301 causes image formation to continue if the sheet-to-sheet interval is detected by the top sensor 121 before the second timer for detecting retention jamming times out. Further, if the sheet-to-sheet interval cannot be detected even if the second timer times out, the engine control CPU 301 presumes that retention jamming has occurred and causes image formation to stop. Accordingly, by virtue of the two-stage arrangement composed of the conveyance sensor 133 of the optional cassette and the top sensor 121 of the main body 100, it can be determined whether the event that has occurred is retention jamming or a sheet-to-sheet interval that is too short. Naturally, in a case where the sheet-to-sheet interval cannot be detected owing to communication delay, etc., sheet transport itself will be normal and therefore it will be unnecessary to cause image formation to stop needlessly as in the prior art. In comparison with the prior art, therefore, the probability that throughput will decline is diminished.

In this embodiment, the engine control CPU 301 causes timekeeping by the second timer to start using the transmission of a feeding instruction as a trigger (S504, S512). This is desirable if one takes into account the fact that retention jamming occurs as a result of the feeding instruction. It is particularly desirable that the engine control CPU 301 restarts the timekeeping by the second timer using as a trigger the feed retry operation (S509, etc.) executed in response to a determination of feeding failure. That is, elapsed time is longer when the retry operation is performed than when it is not performed. Accordingly, that timing of the start of timekeeping by the second timer is changed dynamically is desirable.

In the first embodiment, the order of execution of the processing steps can be changed freely as long as similar actions and effects are obtained. For example, steps S502 to S505 may be executed in any order. The same holds true for steps S509 to S512.

Second Embodiment

In the first embodiment, the timing for starting the second timer for sensing sheet-feed delay jamming or retention jamming is in principle the timing at which the feeding operation starts (S514). Further, when the retry operation is executed, restarting of the second timer is necessary (S512).

In a second embodiment, the second timer is started using as a trigger the timing at which the conveyance sensors 133, 144 sense the leading edge of a sheet or the timing at which a determination that feeding has succeeded is made based upon status data regarding the conveyance sensors 133, 144. As a result, the influence of a difference in processing time between the processing route through steps S506 to S514 and the processing route from step S506 to step S515 or S516 on the second timer can be reduced.

Figure 6A:
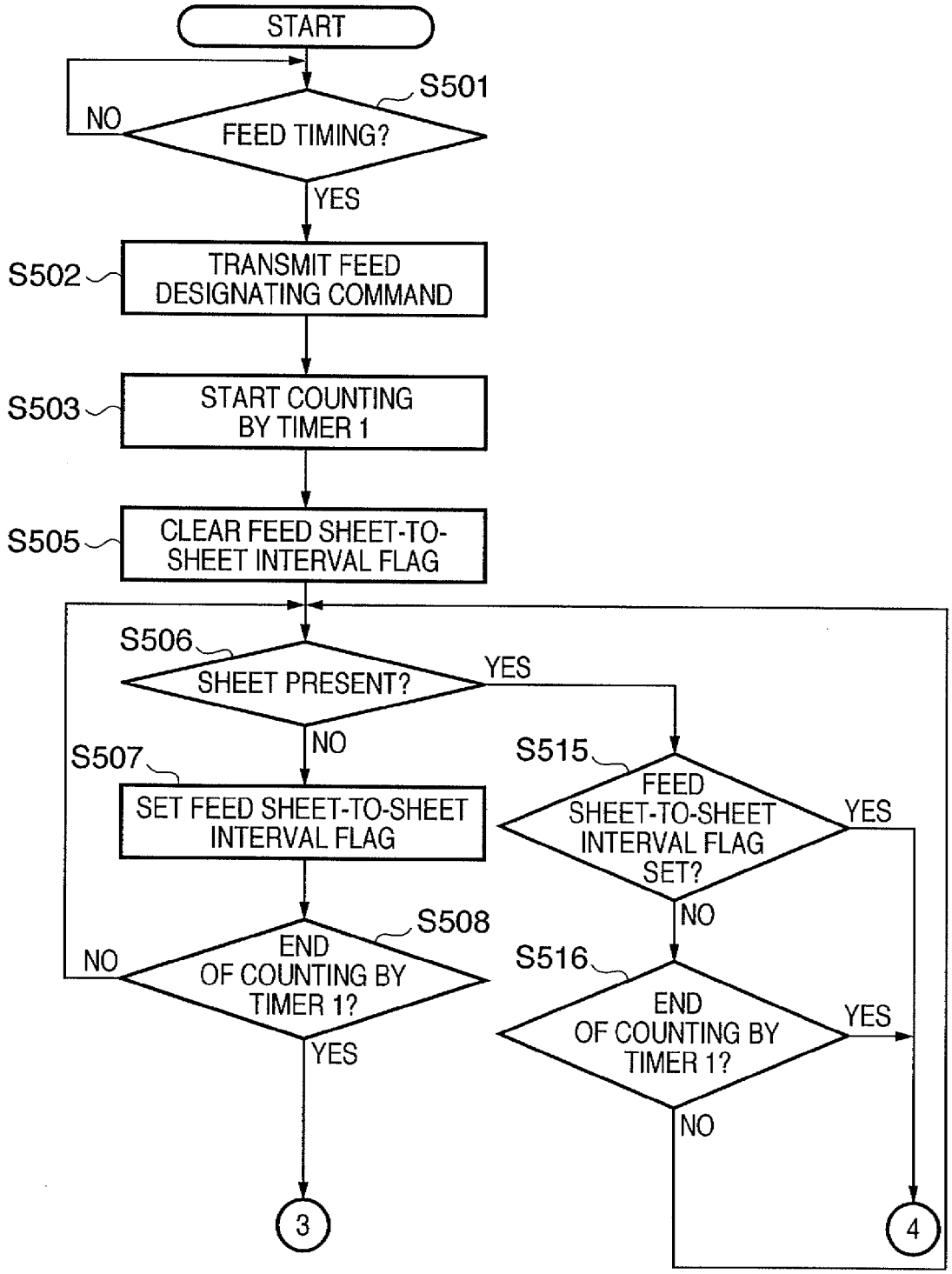
FIGS. 6A and 6B are flowcharts illustrating a control method according to a second embodiment.
Figure 6B:
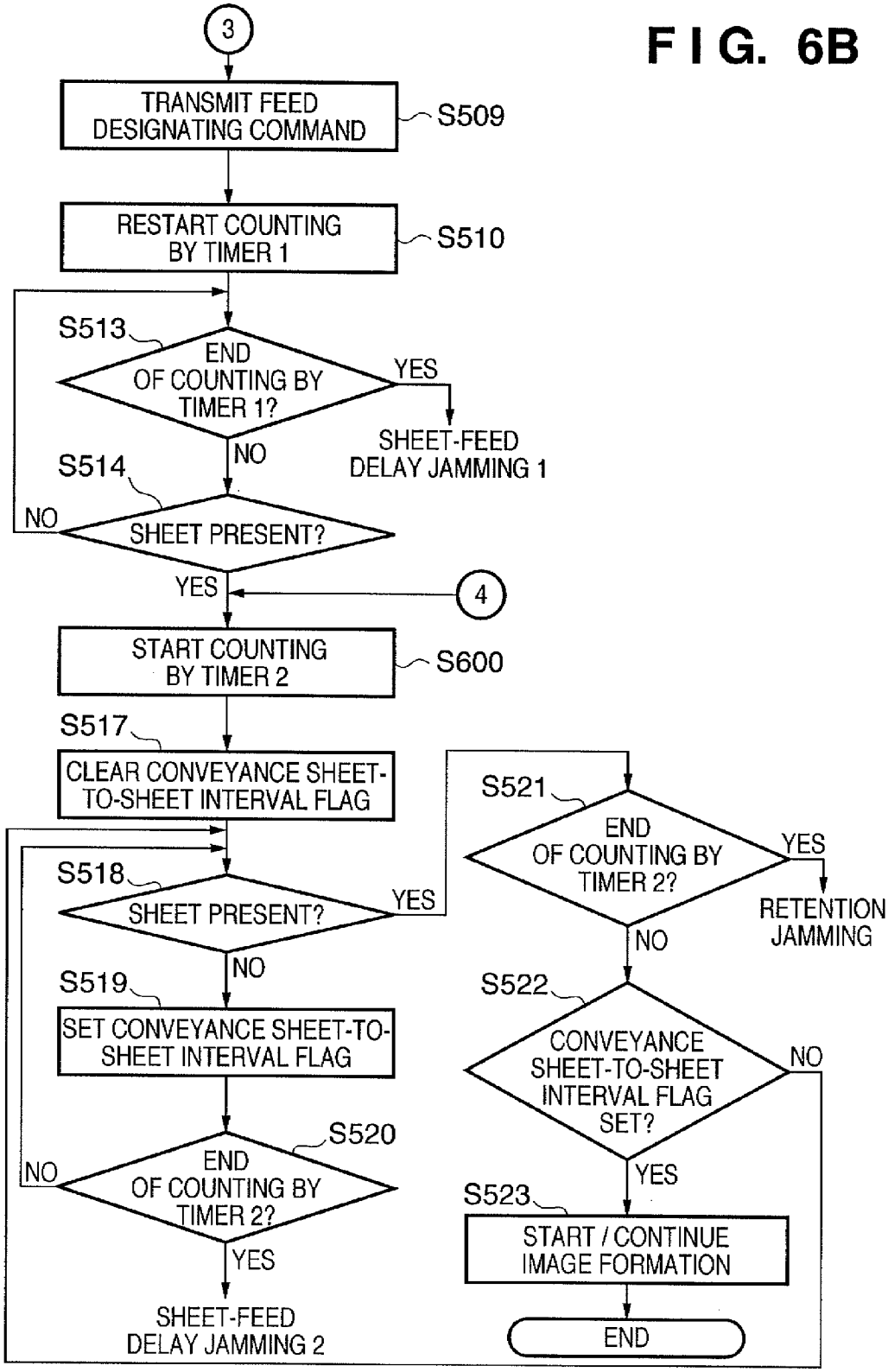

FIGS. 6A and 6B are flowcharts illustrating a control method according to the second embodiment. Steps similar to those in FIGS. 5A and 5B are designated by like step numbers and need not be described again.

If the flowcharts shown in FIGS. 6A and 6B are compared with the flowcharts shown in FIGS. 5A and 5B, it will be understood that steps S504 and S512 have been deleted and that a new step S600 has been inserted between steps S514 and S517. Step S600 is processing where the engine control CPU 301 starts the second timer in a manner similar to that at step S504. It should be noted that one timing for transitioning to step S600 is the timing at which status data changes from absence of a sheet to presence of a sheet.

Thus, in accordance with the second embodiment, timekeeping by the second timer is started using as a trigger a change in the status data from absence of a sheet to presence of a sheet. As a result, the timing at which timekeeping by the second timer starts can be measured in isolation from the timing at which the feeding instruction is transmitted. In comparison with the first embodiment, the time necessary for detection of the sheet-to-sheet interval based upon status data is negligible. As a result, retention jamming and sheet-to-sheet interval can be detected with relatively good accuracy based upon the top sensor 121.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application is a Continuation of U.S. application Ser. No. 12/033,346, which was filed on Feb. 19, 2008, and which claims the benefit of Japanese Patent Application No. 2007-050224, filed Feb. 28, 2007, which are both hereby incorporated by reference herein in their entirety.

What is claimed is:

1. An image forming system comprising;

an image forming device configured to form an image on a sheet;

a sheet feeding device connected with the image forming device, and configured to feed a sheet to the image forming device;

a first sensor provided at the sheet feeding device and configured to detect a sheet fed to the image forming device at a first position on a sheet conveyance path and output a signal regarding an existence or nonexistence of the sheet;

a second sensor provided at the image forming device and configured to detect a sheet fed from the sheet feeding device at a second position which is downstream of the first position in a sheet conveyance direction and output a signal regarding an existence or nonexistence of the sheet; and a controller provided at the image forming device and configured to control operation of the image forming device based on the signal outputted from the first sensor and the signal outputted from the second sensor, wherein the sheet feeding device is further configured to feed a first sheet and a second sheet following the first sheet to the image forming device such that there is an interval between a trailing edge of the first sheet and a leading edge of the second sheet in the sheet conveyance direction, and wherein the controller is further configured to continue the operation of the image forming device in a case where the controller can not detect the interval based on the signal outputted from the first sensor and the controller can detect the interval based on the signal outputted from the second sensor even though the first sheet and the second sheet pass the first position and the second position while maintaining the interval.

2. The image forming system according to claim 1, wherein the controller is further configured to stop the operation of the image forming device in a case where the controller cannot detect the interval based on the signal outputted from the first sensor and the controller cannot detect the interval based on the signal outputted from the second sensor.

3. The image forming system according to claim 2, wherein the controller is further configured to determine that conveyance failure occurs in a case where the controller cannot detect the interval based on the signal outputted from the first sensor and the controller cannot detect the interval based on the signal outputted from the second sensor.

4. The image forming system according to claim 1, wherein the image forming device is further configured to form an image on both of the first sheet and the second sheet.

5. The image forming system according to claim 1, wherein a case where the controller cannot detect the interval based on the signal outputted from the first sensor is a case where the signal outputted from the first sensor remains in an ON state and unchanged.

6. The image forming system according to claim 1, wherein a case where the controller can detect the interval based on the signal outputted from the second sensor is a case where the signal outputted from the second sensor changes from an ON state to an OFF state and subsequently changes from the OFF state to the ON state.

7. The image forming system according to claim 1, further comprising a signal line configured to transmit the signal outputted from the first sensor, wherein the controller is further configured to control the operation of the image forming device based on the signal outputted from the first sensor and transmitted via the signal line and the signal outputted from the second sensor.

8. The image forming system according to claim 7, wherein the signal line is a serial signal line.

9. The image forming system according to claim 8, further comprising an option controller provided at the sheet feeding device and connected with the controller provided at the image forming device via the serial signal line, wherein the option controller detects the signal outputted from the first sensor and transmits detection result to the controller via the serial signal line.

10. The image forming system according to claim 9, wherein a plurality of the sheet feeding device are provided in the image forming system, each of which includes the first sensor and the option controller, and signals respectively outputted from the first sensor in the plurality of the sheet feeding device are respectively sent from the option controller in the plurality of the sheet feeding device to the controller via the serial signal line which is commonly provided for the plurality of the sheet feeding device.

11. The image forming system according to claim 1, wherein the controller is further configured to continue the operation of the image forming device in a case where the controller can detect the interval based on the signal outputted from the first sensor and the controller can detect the interval based on the signal outputted from the second sensor.

12. The image forming system according to claim 1, wherein the controller is further configured to cause the image forming device to continue the image formation of the first sheet in a case where the controller cannot detect the interval based on the signal outputted from the first sensor and the controller can detect the interval based on the signal outputted from the second sensor.

13. The image forming system according to claim 1, wherein the controller is further configured to stop the operation of the image forming device in a case where the controller can detect the interval based on the signal outputted from the first sensor and the controller cannot detect the interval based on the signal outputted from the second sensor.

14. The image forming system according to claim 1, wherein the controller is further configured to continue the operation of the image forming device in a case where the controller can detect a leading edge of the first sheet based on the signal outputted from the first sensor during a period from when the sheet feeding device starts to feed the first sheet to when a first time passes, wherein the controller is further configured to stop the operation of the image forming device in a case where the controller cannot detect the leading edge of the first sheet based on the signal outputted from the first sensor during the period.

15. The image forming system according to claim 14, wherein the controller is further configured to continue the operation of the image forming device in a case where the controller can detect the leading edge of the first sheet based on the signal outputted from the second sensor during a period from when the sheet feeding device starts to feed the first sheet to when a second time that is longer than the first time passes, wherein the controller is further configured to stop the operation of the image forming device in a case where the controller cannot detect the leading edge of the first sheet based on the signal outputted from the second sensor during the period.

16. The image forming system according to claim 1, wherein the operation of the image forming device is image formation on the first sheet and the second sheet.

* * * * *